US005588872A

United States Patent [19]

Fukuda

[11] Patent Number: 5,588,872

[45] Date of Patent: Dec. 31, 1996

[54] CONNECTOR WITH ENGAGEMENT CHECKING STRUCTURE

[75] Inventor: Masaru Fukuda, Shizuoka, Japan

[73] Assignee: Yazaki Corporation, Tokyo, Japan

[21] Appl. No.: 314,792

[22] Filed: Sep. 29, 1994

[30] Foreign Application Priority Data

Sep. 30, 1993 [JP] Japan ..... 5-245328

[51] Int. Cl.[6] ..... H01R 3/00

[52] U.S. Cl. ..... 439/489; 439/188

[58] Field of Search ..... 439/345, 350, 439/354, 357, 358, 488, 489, 188

[56] References Cited

U.S. PATENT DOCUMENTS

| | | | |
|---|---|---|---|
| 4,900,267 | 2/1990 | Nagasaka et al. . | |
| 5,061,204 | 10/1991 | Murakami . | |
| 5,127,848 | 7/1992 | Taguchi . | |
| 5,131,865 | 7/1992 | Taguchi et al. . | |
| 5,277,608 | 1/1994 | Oda | 439/188 |

FOREIGN PATENT DOCUMENTS

| | | |
|---|---|---|
| 3-3982 | 1/1991 | Japan . |
| 3-82574 | 8/1991 | Japan . |
| 3-208275 | 9/1991 | Japan . |
| 4-3419 | 2/1992 | Japan . |

*Primary Examiner*—Khiem Nguyen
*Attorney, Agent, or Firm*—Armstrong, Westerman, Hattori, McLeland & Naughton

[57] ABSTRACT

A connector couple has an engagement checking structure including a first connector housing having a resilient lock arm and a second connector housing having an engagement portion for receiving to the resilient lock arm. On the resilient lock arm of the first connector housing, a short-circuit contact piece is provided, while, on the engagement portion of the second connector housing, a couple of terminal pins for detecting engagement are provided such that the terminal pins are positioned outside of both sides of the resilient lock arm when the first connector housing has engaged with the second connector housing so that, when the first connector housing has completely engaged with the second connector housing and the resilient lock arm has returned to its original position, the short-circuit contact piece makes electric connection with the terminal pins.

4 Claims, 4 Drawing Sheets

CONNECTOR WITH ENGAGEMENT CHECKING STRUCTURE

BACKGROUND OF THE INVENTION (1) Field of the Invention

This invention relates to a couple of connectors for use as automobile wiring harnesses, or the like, and more particularly to a couple of connectors with an engagement checking structure having means for detecting a completely engaged state of a connector couple.

(2) Prior Art

Referring to FIGS. 5 and 6, A designates a male connector housing, B designates a female connector housing, and each of them is formed of synthetic resin materials.

In the male connector housing A, a plurality of terminal receiving cavities 1 are formed, as is well known, and female terminal pieces C are inserted to be secured therein.

Similarly, in the female connector housing B, a plurality of terminal receiving cavities (not illustrated in the drawings) are formed, and male terminal pieces D are inserted to be secured therein.

In a concave portion 2 of an upper surface of the male connector housing A, a cantilever resilient lock arm 3 with a vertical base member 3*a* is provided as extending afterward. On an upper surface of a middle part of the resilient lock arm 3, a lock projection 3*b* is formed, and on a free end of the resilient lock arm 3, a push portion 3*c* for unlocking is provided. In a center portion of a forward end of a top wall 4, in regard to the female connector housing B, an engaging frame 5 corresponding to the resilient lock arm 3 is provided, and a lock opening 5*a* corresponding to the lock projection 3*b* is also formed on the top wall 4.

The aforementioned structure is well known art wherein, when the male connector housing A and the female connector housings B engage with each other, the female terminal pieces C and the male terminal pieces D make contact with each other. At that time, the lock projection 3*b* abuts the engaging frame 5, whereby the resilient lock arm 3 deflects downwardly into a lower space R provided for allowing a deflection of the resilient lock arm 3 and, thereafter, the lock projection 3*b* reaches to the lock opening 5*a*. As the resilient lock arm 3 returns to the original position, the male connector housing A and the female connector housing B are completely engaged with each other and locked thereby.

Numeral 6 denotes a contact piece for detecting engagement. The contact piece 6 has a pair of elastic contact portions 6*b*/6*b* which rise up from a folded corner 6' at one end of a base plate 6*a* and has, at the other end of the base plate 6*a*, a terminal nose piece 6*c* being folded oppositely to the elastic contact portion 6*b*. The terminal nose piece 6*c* has a tab which extends afterward from a folded corner 6" thereof. A pair of contact pieces 6/6 for detecting engagement are secured by engaging the folded corner 6' thereof with an end of a compartment wall between the concave portion 2 and the terminal receiving cavity 1' adjacent to the concave portion 2. Thereby, a couple of the elastic contact portions 6*b*/6*b* rise up in the space R for allowing a deflection, opposing the free end of the resilient lock arm 3. And the terminal nose pieces 6*c*/6*c* with the tab are oppositely secured in the respective terminal-receiving cavities 1'/1' The terminal nose pieces 6*c*/6*c* with the tab are connected with the normal female terminal pieces C. An electric detection circuit is composed thereby.

Numeral 7 designates a short-circuit contact member which is formed of an elastic metal and is gate-shaped. The legs 7*a*/7*a* of the short-circuit contact member 7 each have an outwardly folded contact piece 7*b*. The short-circuit contact member 7, wherein the folded contact pieces 7*b*/7*b* are engaged by an associated strip 5*b* on the engaging frame 5, is fixed to the engaging frame 5 by an adhesive, or the like.

In the above-mentioned structure, when the male connector housing A and the female connector housing B are incompletely engaged with each other, the free end of the resilient lock arm 3, as illustrated in FIG. 6B, deflects downwardly and also forces the elastic contact portions 6*b*/6*b* of the contact pieces 6/6 to deflect for detecting engagement. Therefore, as the short-circuit contact member 7 is isolated from the elastic contact portions 6*b*/6*b*, the detecting electric circuit does not operate.

On the other hand, when the male connector housing A and the female connector housing B are completely engaged to each other, the resilient lock arm 3, as illustrated in FIG. 6C, returns to its original position and also the elastic contact portions 6*b*/6*b* of the contact pieces 6/6 for detecting engagement return to their original position. Thereby, the elastic contact portions 6*b*/6*b* make contact with the short-circuit contact member 7 and the detecting electric circuit operates.

In the above-mentioned prior art, the male connector housing with the resilient lock arm 3 has a couple of the contact pieces for detecting engagement, and the female connector housing has the short-circuit contact member. Further, the male connector housing A has a couple of female terminal pieces, which, when engagement between the terminal pieces and the housing is complete, are connected to the contact pieces 6 to detect the complete engagement. Consequently, the described engagement checking structure is so complicated that more compact ones have been sought.

SUMMARY OF THE DISCLOSURE

The invention aims to solve the above problem and provides a couple of connectors with a more compact engagement checking structure by omitting the above-mentioned contact pieces in the detection of the complete engagement.

For the sake of achieving the object, in this invention a couple of connectors with a more compact engagement checking structure comprises:

a first connector housing with a resilient lock arm;

a second connector housing having an engagement portion for engaging the resilient lock arm;

wherein, on the resilient lock arm of the first connector housing, a short-circuit contact piece is provided, on the engagement portion of the second connector housing a couple of terminal pins for detecting engagement are provided such that the terminal pins are positioned laterally outside of the respective sides of the resilient lock arm when the first connector housing has engaged the second connector housing, when the first connector housing has completely engaged the second connector housing and the resilient lock arm has returned to its original position, the short-circuit contact piece makes electric connection with the couple of the terminal pins.

Therefore, when the first connector housing and the second connector housing are incompletely engaged with each other, the short-circuit contact piece is isolated from the terminal pins for detecting engagement.

On the other hand, when the male connector housing and the female connector housing are completely engaged with each other, the resilient lock arm returns to the original position and, thus, the short-circuit contact piece makes electric connection with the terminal pins for detecting complete engagement.

Other features of the invention will become apparent to those skilled in the art as the disclosure is made in the following detailed description of a preferred embodiment of the invention as illustrated in the accompanying sheets of drawings.

DESCRIPTION OF PREFERRED EMBODIMENT

Figure 1:
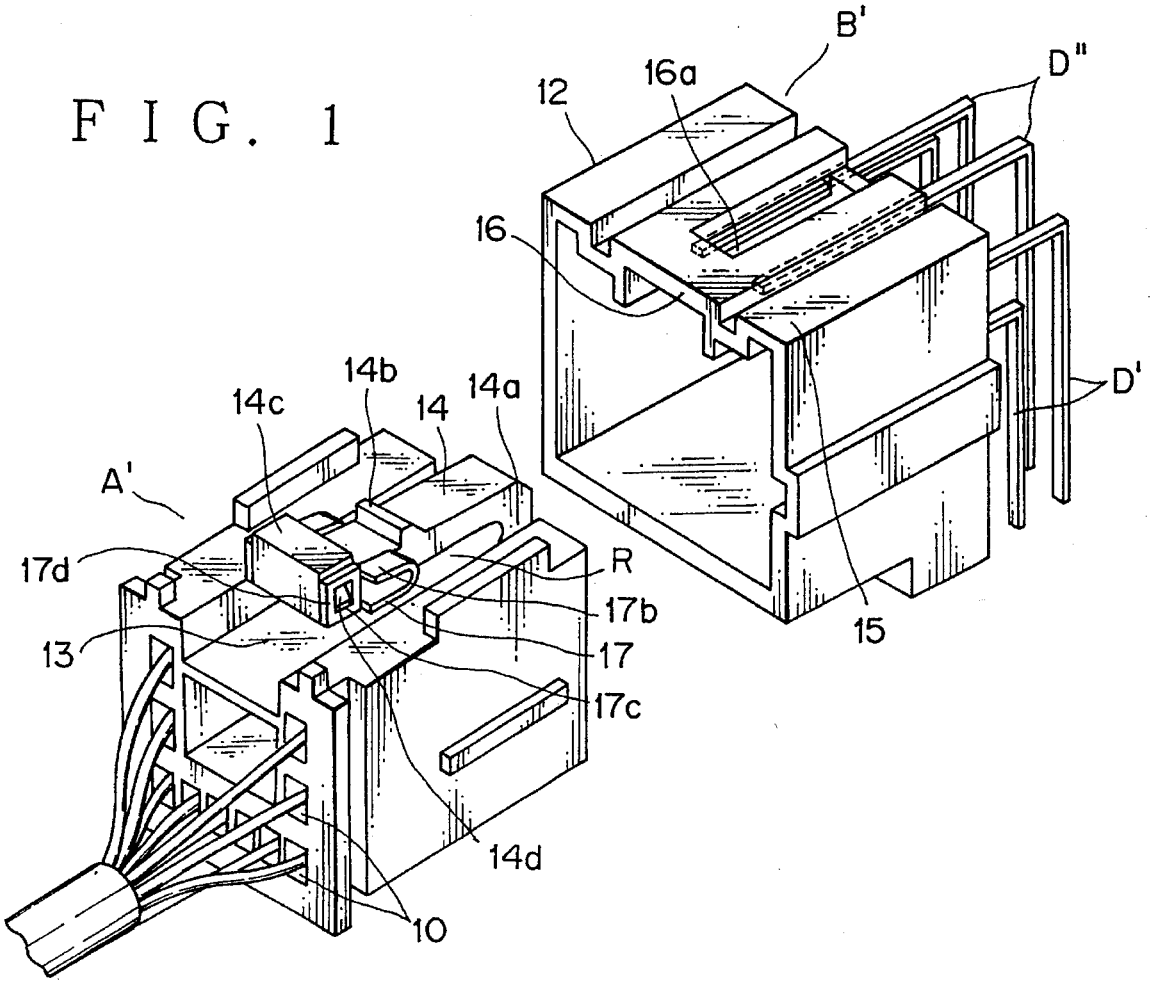
FIG. 1 is a perspective view of an embodiment of this invention, in which a male connector housing and a female connector housing are separated.
Figure 2:
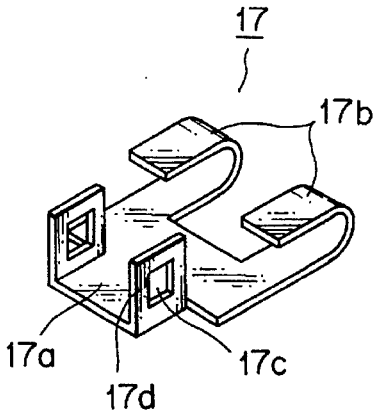
FIG. 2 is a perspective view of a short-circuit contact piece in regard to the embodiment.

Referring to FIG. 1, numeral A' denotes a male connector housing, numeral B' denotes a female connector housing for a primed circuit board, and both of the housings are formed of synthetic resin materials.

Figure 3:
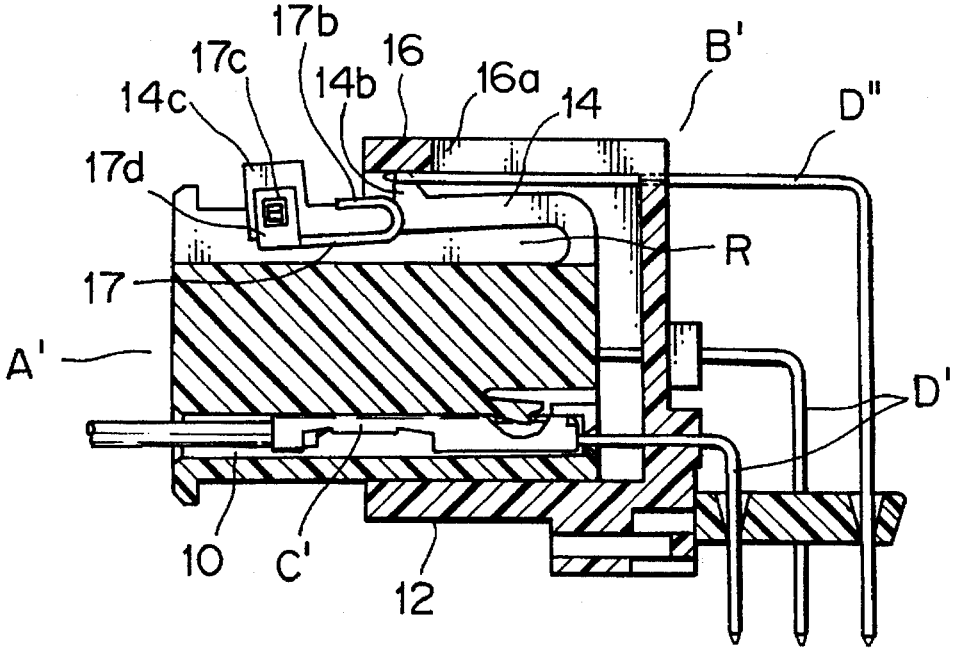
FIG. 3 is a longitudinal sectional view of an incomplete engagement state of the male connector housing and the female connector housing in regard to the embodiment.
Figure 4:
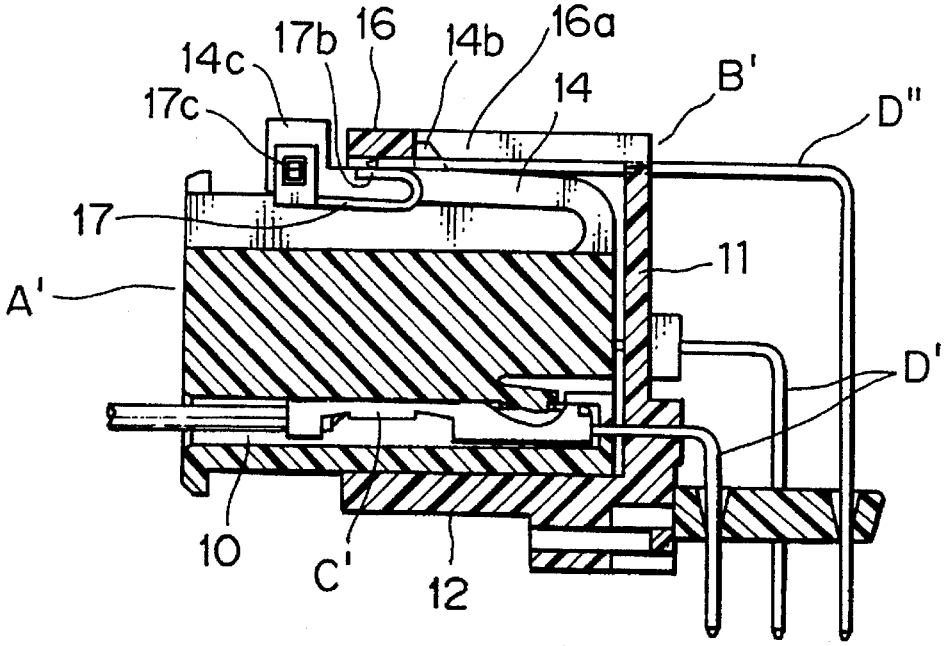
FIG. 4 is a longitudinal sectional view of a complete engagement state of the male connector housing and the female connector housing in regard to the embodiment.
Figure 5:
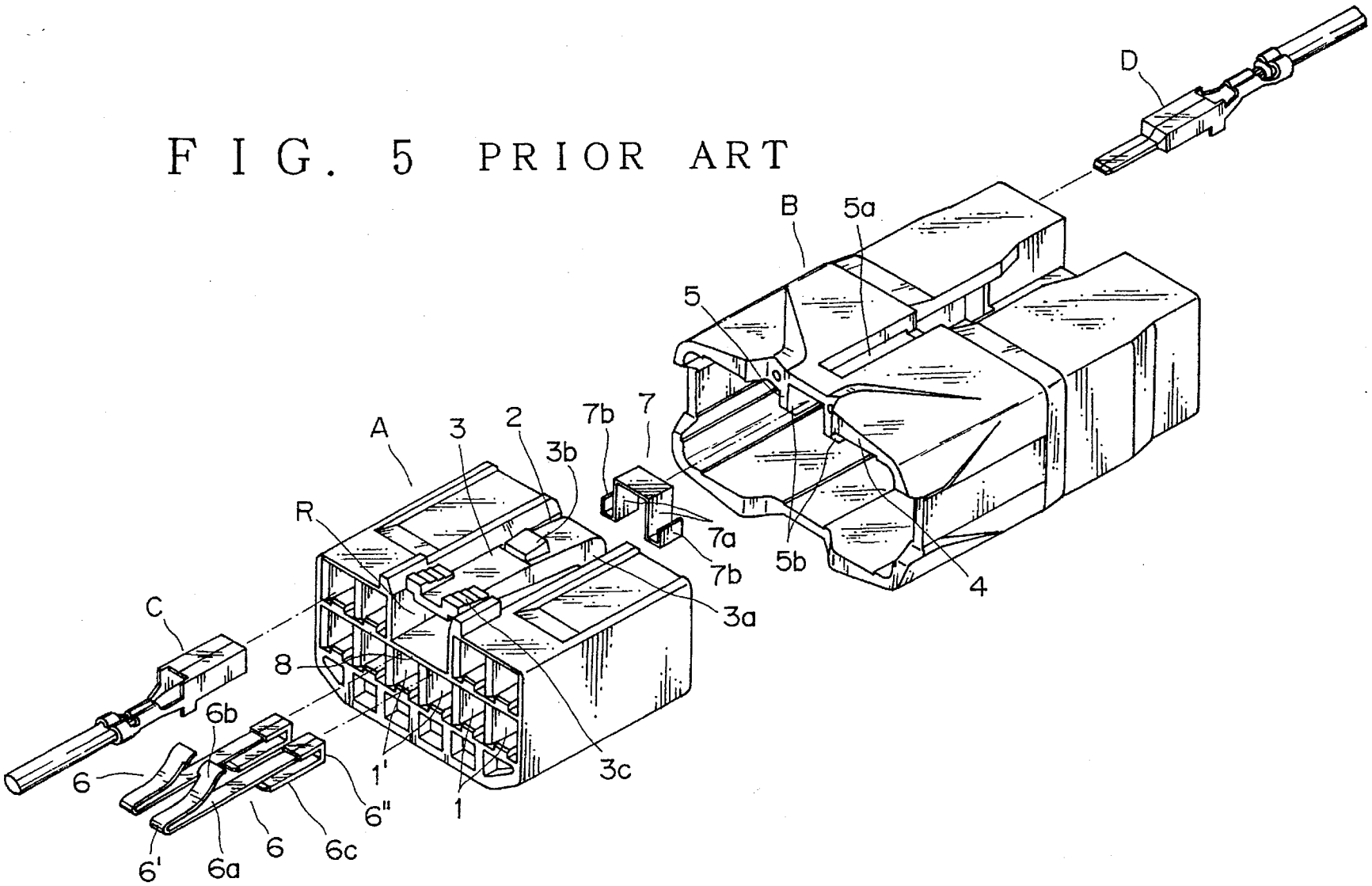
FIG. 5 PRIOR ART
FIG. 5 is a perspective view of a prior art device, in which a male connector housing and a female connector housing are separated.
Figure 6A:
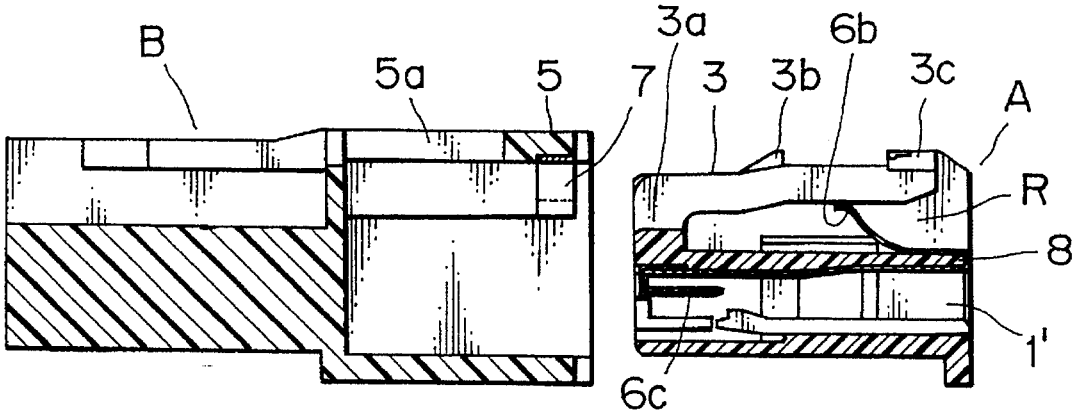
FIG. 6A PRIOR ART
FIGS. 6A, 6B and 6C are longitudinal sectional views in regard to the prior art; the male connector housing and the female connector housing being separated in FIG. 6A, being incompletely engaged with each other in FIG. 6B, and being completely engaged with each other in FIG. 6C.
Figure 6B:
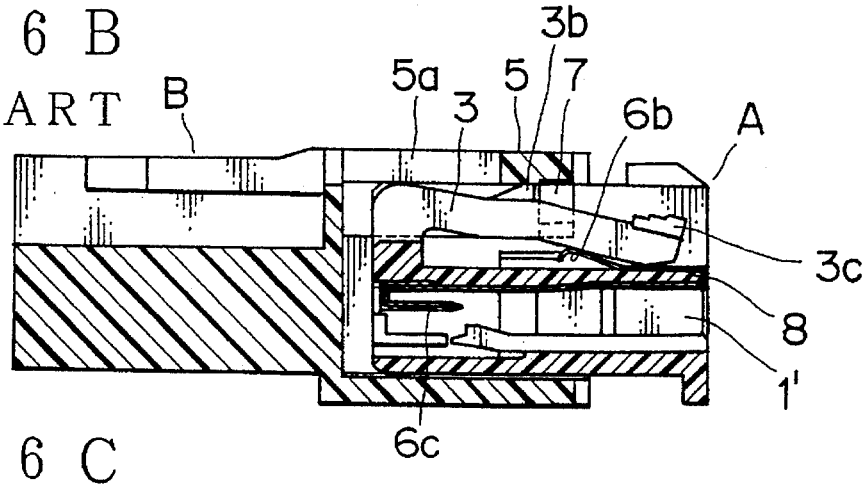
FIG. 6B PRIOR ART
Figure 6C:
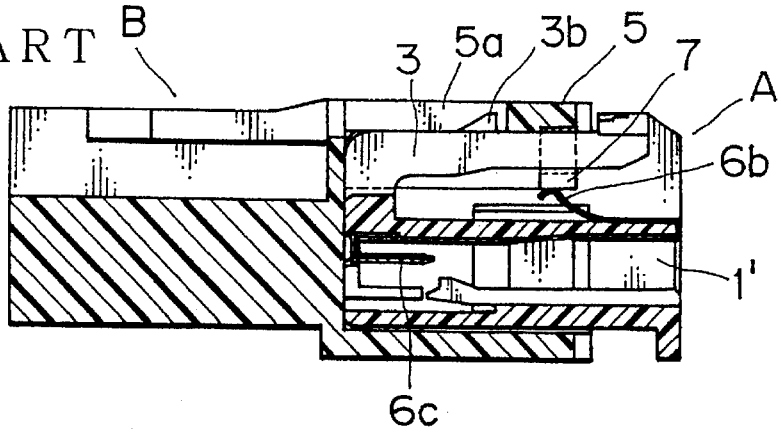
FIG. 6C PRIOR ART

In the male connector housing A', a plurality of terminal receiving cavities 10 are formed and female terminal pieces C' are adapted, when inserted into the cavities, to be secured therein (as illustrated in FIG. 3). In regard to the female connector housing B, a plurality of terminal pins D', supported by a rear wall 11, are aligned in the housing 12.

In a concave portion 13 on an upper surface of the male connector housing A', a cantilever resilient lock arm 14 with a vertical base member 14*a* is provided extending backwardly from a push portion 14*c*. On an upper surface of a middle part of the resilient lock arm 14, a lock projection 14*b* is formed, and on an upper surface of the free end portion of the resilient lock arm 14, the push portion 14*c* for unlocking the connection is provided. At a center part of a forward end of a top wall 15 in regard to the female connector housing B', an engaging frame 16 corresponding to the resilient lock arm 14 is provided and a lock opening 16*a* corresponding to the lock projection 14*b* is also formed.

When the male connector housing A' and the female connector housing B' engage with each other, the female terminal pieces C' and the male terminal pins D' make contact with each other. At that time, the lock projection 14*b*, first, abuts on a fore end of the engaging frame 16, whereby the resilient lock arm 14 deflects resiliently downwardly into a lower space R operative to receive the resilient lock arm 14. Upon further relative movement between the male and female connector housings A' and B', the lock projection 14*b* reaches the lock opening 16*a* and, as the resilient lock arm 3 returns to its original position, the male connector housing A' and the female connector housing B' are completely engaged with each other and locked thereby.

On the engaging frame 16, a couple of terminal pins D" for detecting engagement are provided such that the terminal pins are positioned adjacent each side of the resilient lock arm 14 when the male connector housing A' has engaged with the female connector housing B'.

On the resilient lock arm 14, a short-circuit contact element 17 is provided, wherein the short-circuit contact piece 17 is formed of an elastic metal plate.

The short-circuit contact element 17 has a base plate 17*a*, wherein a pair of folded elastic contact pieces 17*b*/17*b* extend forward, in spaced, parallel relation, from a fore end of the base plate 17*a*, and a pair of fitting tabs 17*d*, each with a latch opening 17*c*, are formed on both sides of the base plate 17*a*. And, as the upper surface of the base plate 17*a* is abutted to the bottom surface of the resilient lock arm 14, a pair of latch protrusions 14*d* positioned on both sides of the resilient lock arm 14 are engaged with the each latch opening 17*c* of the fitting tabs 17*d*, whereby the contact element 17 is secured to the resilient lock arm 14, wherein the folded elastic contact pieces 17*b*/17*b* are positioned outside of both sides of the resilient lock arm.

In the above-mentioned structure, when the male connector housing A' and the receiving connector housing B' are incompletely engaged with each other, as the lock projection 14*b* abuts the engage frame 16, whereby the resilient lock arm 14 deflects downwardly into the lower space R, the folded elastic contact pieces 17*b*/17*b* of the contact element 17 are isolated from the couple of terminal pins D" for detecting engagement (as illustrated in FIG. 3).

On the other hand, when the male connector housing A' and the receiving connector housing B' are completely engaged to each other, the lock projection 14*b* engages with the lock opening 16*a*, the resilient lock arm 14 returns to its original position, and the folded elastic contact pieces 17*b*/17*b* of the contact element 17 make contact with the terminal pins D"/D" for detecting engagement. Consequently, a detecting electric circuit is activated.

In this invention, as mentioned above, a couple of connectors are provided with an engagement checking structure which comprises:

a first connector housing with a resilient lock arm;

a second connector housing having an engagement portion to cooperate with the resilient lock arm;

wherein, on the resilient lock arm of the first connector housing, a short-circuit contact element is provided, on the engagement portion of the second connector housing, a couple of terminal pins for detecting engagement are provided such that the couple of the terminal pins are positioned outside of both sides of the resilient lock arm when the first connector housing has engaged with the second connector housing, and when the first connector housing has completely engaged with the second connector housing and the resilient lock arm has returned to its original position, contact pieces on the short-circuit contact element make electric connection with the terminal pins.

As a result, this invention provides a couple of connectors with a more compact engagement checking structure enabling the omission of the conventional contact pieces for detecting engagement.

What is claimed is:

1. An engagement checking structure for coupled connector housings, comprising:

a first connector housing containing a resilient lock arm integrally formed on said first housing as a cantilever member having one end fixed to a surface of said housing and its other end resiliently movable perpendicularly to said surface, a locking projection formed on said lock arm, a second connector housing having an engagement portion cooperable with said locking projection to resiliently urge said lock arm toward said surface of said first connector housing as said connector housings are placed in incomplete engaged relation, and to cooperate with said locking projection to retain said connector housings in locked relation upon said locking arm resiliently returning to its original position when said connector housings are placed in complete engaged relation;

a pair of terminal pins operative for detecting complete engagement between said connector housings and disposed on said second housing in laterally spaced relation from said locking arm upon movement of said first connector housing with respect to said second connector housing; and a short circuit contact element mounted on said lock arm, said contact element having contact pieces extending laterally oppositely from said arm and means for attaching said contact element to said arm intermediate said contact pieces, said contact pieces being engageable with said terminal pins when said connector housings are in complete engaged relation whereby electrical connections are made between said contact pieces and said terminal pins.

2. The engagement checking structure for coupled connector housings as recited in claim 1, wherein said first connector housing is a male housing and said second connector housing is a female housing.

3. The engagement checking structure for coupled connector housings as recited in claim 1, wherein said short circuit contact element contains a pair of fitting tabs, each containing a latch opening, and a pair of latch protrusions cooperable with said latch openings for securing said short circuit contact element to said resilient lock arm formed on both sides of the resilient lock arm.

4. The engagement checking structure for coupled connector housings as recited in claim 3, wherein said short-circuit contact element includes a base plate and a pair of laterally spaced, folded elastic contact pieces extending from a fore end of said base plate.

* * * * *